United States Patent [19]

Shaffer

[11] 4,304,296

[45] Dec. 8, 1981

[54] BODY ASSEMBLY FOR A FLUID COOLER

[75] Inventor: Robert W. Shaffer, Campbellsville, Ky.

[73] Assignee: Ingersoll-Rand Co., Woodcliff Lake, N.J.

[21] Appl. No.: 28,538

[22] Filed: Apr. 9, 1979

[51] Int. Cl.[3] ..... F28F 13/00; H02K 9/06; H02K 5/18; F04B 39/06

[52] U.S. Cl. ..... 165/125; 62/508; 417/366; 310/57; 310/59; 310/60 A; 310/64; 165/185

[58] Field of Search ..... 165/154, 125, 179, 181–186; 417/366, 8; 310/54, 64, 57–59, 60 R, 60 A; 62/508

[56] References Cited

U.S. PATENT DOCUMENTS

| | | | |
|---|---|---|---|
| 2,120,914 | 6/1938 | Vogel | 417/368 |
| 2,663,170 | 12/1953 | Gluyer | 165/179 X |
| 3,457,439 | 7/1969 | Gering et al. | 310/64 X |

FOREIGN PATENT DOCUMENTS

| | | | |
|---|---|---|---|
| 542303 | 5/1977 | U.S.S.R. | 310/65 |

*Primary Examiner*—Samuel Scott
*Assistant Examiner*—Theophil W. Streule, Jr.
*Attorney, Agent, or Firm*—David W. Tibbott; Bernard J. Murphy

[57] ABSTRACT

According to the embodiment shown, the novel body assembly, for use as a principal component for a fluid cooler, comprises a body of annular configuration formed from a pair of mirror-image halves which are fastened together to form a fluid-conducting channel therewithin. Each of the mating halves has a multiplicity of heat-radiating fins or ribs on the surface thereof which defines an outer surface of the body assembly. Additionally, the halves of the body have fins on their opposite surfaces and, on assembly together, these latter are interleaved, and define an undulating channel through which the fluid to be cooled is conducted.

15 Claims, 8 Drawing Figures

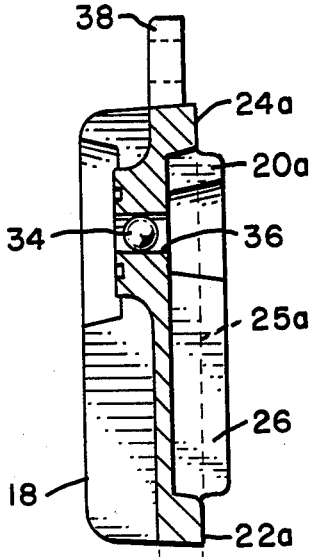
FIG. 3
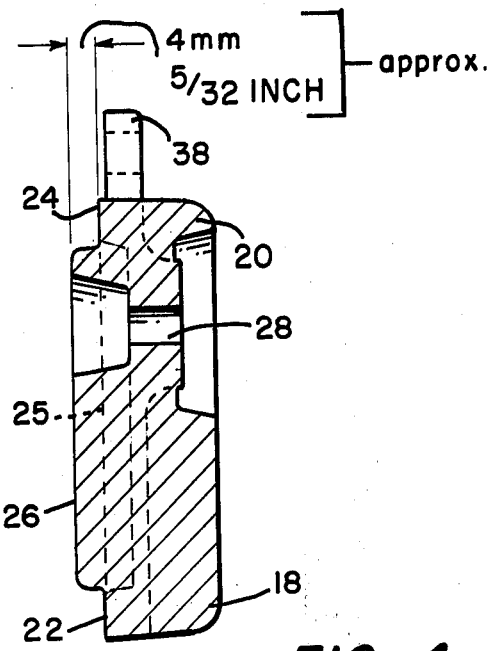
FIG. 4
5mm
7/32 INCH
approx.
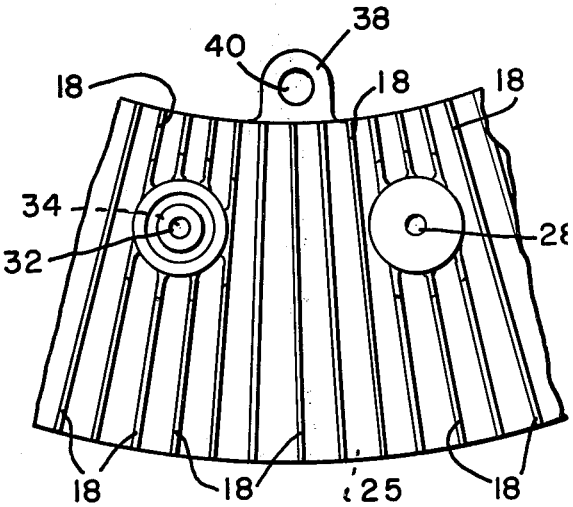
FIG. 6
FIG. 5
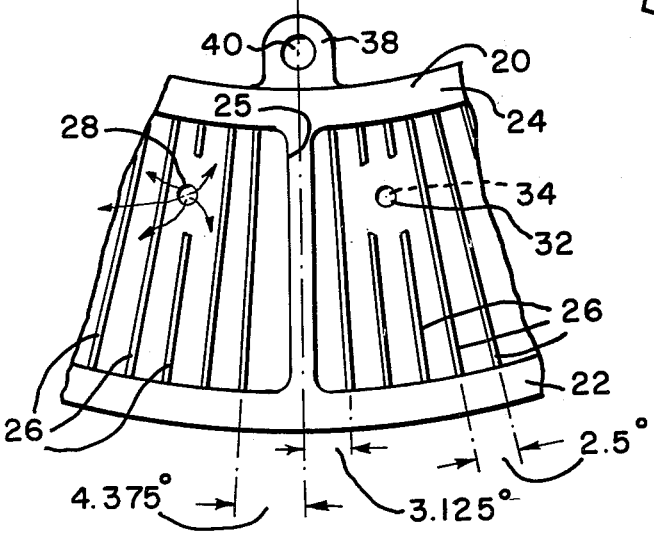

BODY ASSEMBLY FOR A FLUID COOLER

This invention pertains to heat exchangers, coolers for fluid, and like apparatus, and particularly to a body assembly, for a fluid cooler, of novel, simple, and economical construction.

Coolers known in the prior art are typically of complex and expensive construction. A exemplary prior art cooler is that set forth in U.S. Pat. No. 2,329,953, issued on Sept. 21, 1943, to Carl E. Staky for a "Compressed Air Cooler". In this patentee's device, a plurality of air coolers are vertically stacked and serially connected. Each thereof comprises a body assembly having a multiplicity of external, heat-radiating fins and has therewithin a channel for cooling air. The channel is somewhat undulated or, at least, it has a plurality of arcuate grooves formed therewithin, to increase air cooling surfaces. The patentee's cooler is of unitized construction and, needs to be quite expensive to manufacture. The problem with a cooler of the type discosed by the patentee, is that such, typically, is formed from a sand casting. Sand casting is quite expensive and has problems attendant therewith, not the least of which concerns the difficulties of clean-out of the core. Also, many pipe fittings are needed to interconnect such coolers.

It is an object of this invention to set forth an improved body assembly for a fluid cooler which is simple and inexpensive to manufacture, which has great multiplicities of cooling surfaces within and without, which can be fabricated from a single die or permanent mold which forms only halves of the body assembly, and which can be easily stacked, in juxtaposition, without fittings for increasing cooling capacity.

Particularly, it is an object of this invention to set forth a body assembly for a fluid cooler, comprising a body; said body having a curvilinear configuration, and being formed of a pair of mating elements; each of said elements having a first surface which defines an outer surface of said body, and a second surface which defines and inner surface of said body; said second surfaces of said elements each having a first, peripheral land formed thereon, and a second land spaced-apart from, and concentric with, said peripheral land; said peripheral lands of said elements and said concentric lands of said elements being closed upon each other to define a sealed interface therebetween; and means formed on said second surfaces of said elements, intermediate said lands thereof, which cooperatively define an undulating, fluid-accommodating channel within said body.

Further objects of this invention, as well as the novel features thereof, will become more apparent by reference to the following description taken in conjunction with the accompanying figures, in which:

FIGS. 3 and 4 are cross-sectional views of the mating halves of the novel body assembly.

FIG. 5 is a fragmentary, elevational view of one side, the inner side of a cooler assembly-forming element;

FIG. 6 is fragmentary, elevational view of one opposite, outer side of the element of FIG. 5;

Figure 1:
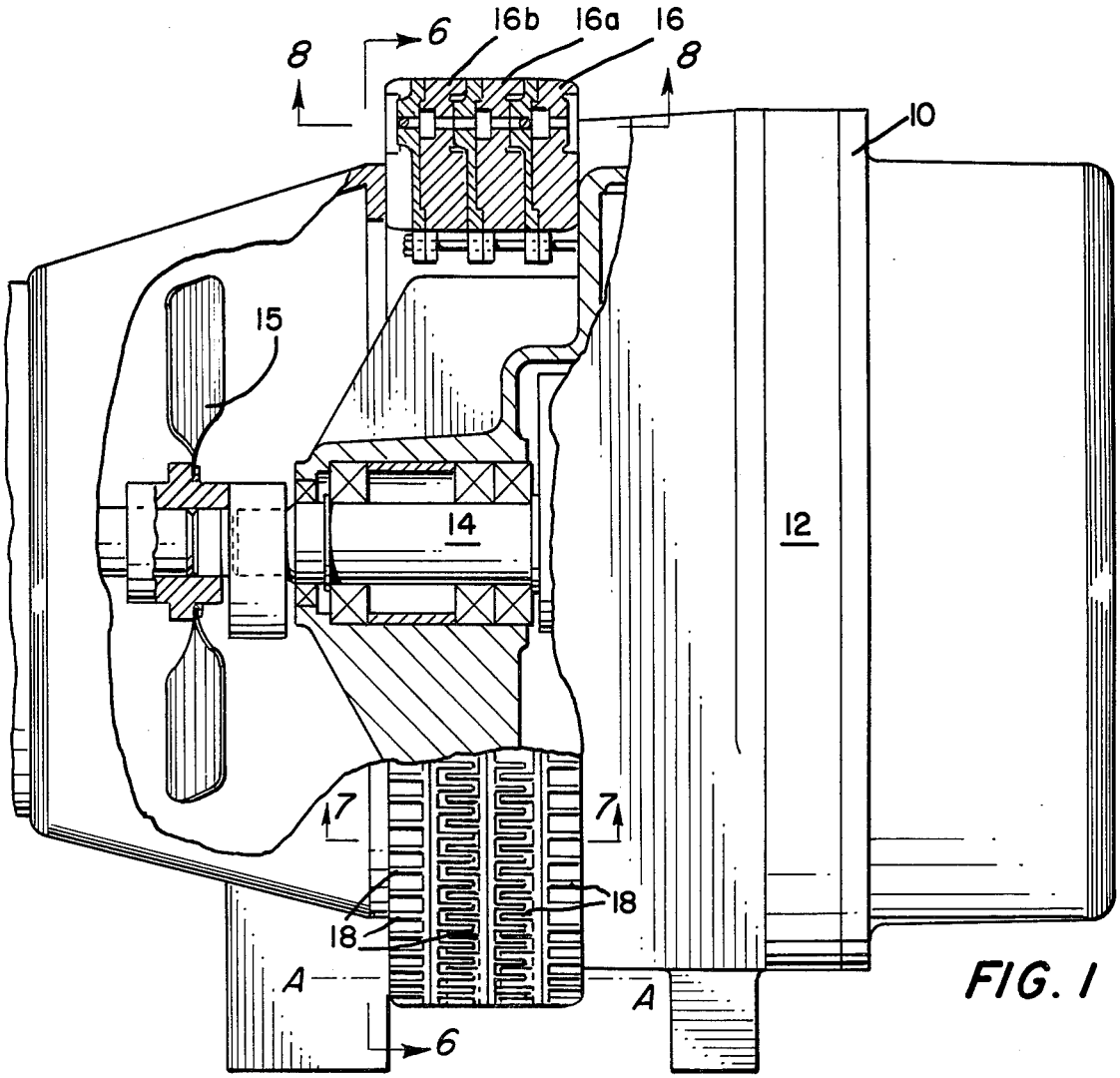
FIG. 1 is a side elevational view, partly broken away and partially cross-sectioned, showing a major portion of a machine (i.e., a rotary air compressor) in combination with a plurality of the novel, fluid cooler body assemblies.

As shown in the figures, a machine 10 such as a rotary air compressor, comprises a housing 12 in which there is mounted a shaft 14 which is coupled to and drives the rotary element or elements of the compressor and a cooling fan 15. Mounted about the outer surface of the housing are three body assemblies 16, **16*a* and 16*b*, for a fluid cooler, according to an embodiment of the invention. The body assemblies are identical and, as noted, they are fixed on the housing 12, in juxtaposition, the housing being circular, and the body assemblies 16, 16*a* and 16*b* being annular. The shaft carries the fan 15 for moving cooling air across external, heat-radiating fins 18** of the body assemblies, and more of the fins and the heat-exchanging structure is explained in the ensuing text.

Figure 2:
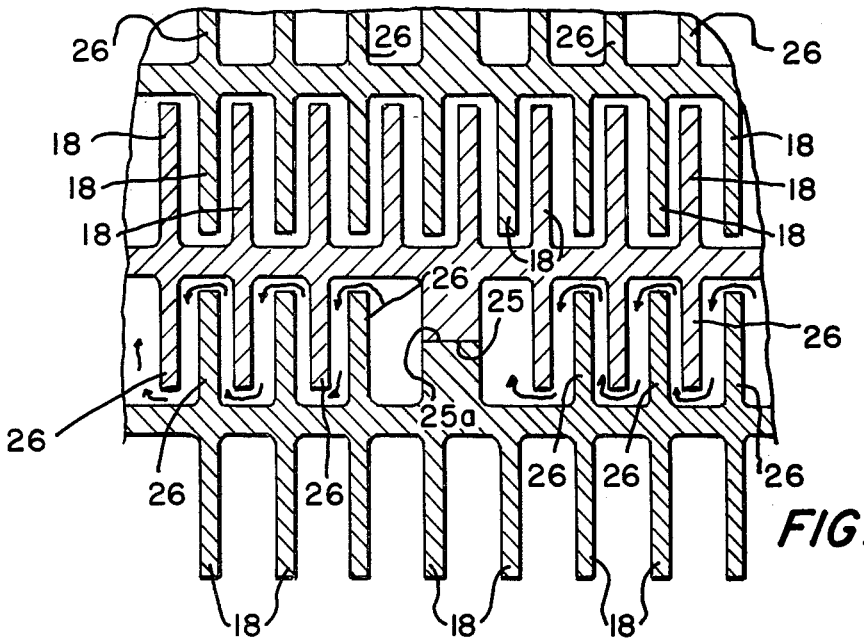
FIG. 2 is a fragmentary, cross-sectional view, greatly simplified to show, with clarity, the nesting of the body assemblies; the view is taken substantially along plane A of FIG. 1, and is turned ninety degrees, counterclockwise, to accommodate an appreciable portion or section on the sheet.

As shown, especially in FIGS. 3 through 7, each of the body assemblies comprises first and second body elements 20 and **20*a* which have peripheral lands 22 and 22*a*, second lands 24 and 24*a* concentric with, and spaced apart from the peripheral lands, and radial lands 25 and 25*a* which join or close upon each other, respectively, to form a sealed interface therebetween. Upon the lands 22 and 22*a*, 24 and 24*a*, and 25 and 25*a* forming closed interfaces, further radial fins 26, projecting from each of the body elements 20 and 20*a*, become interleaved in a non-contacting, equally-spaced apart, aligned relationship. Accordingly, as shown in FIG. 2, and represented by the flow arrows, there is formed a serpentine or undulating passage for the conduct therethrough of the fluid to be cooled. Port 28 admits fluid into the body assembly 16, and port 30 discharges the same therefrom either to the machine or, as in the arrangement shown, to the second body assembly 16*a* via ports 28*a* and 30*a*, and on to the third body assembly 16*b* via ports 28*b* and 30*b*, and then to the machine 10 (via conduitry not shown). Alternatively, the assembly 16 could be the last fluid cooler, assembly 16*b* being the first. Such flow arrangements are optional. Port 36, in element 20*a* of body assembly 16, which is in alignment with port 28, is plugged with a ball 34. Hence, as the to-be-cooled oil or air traverses or cycles through the serpentine channel presented by mated elements 20 and 20*a*, and comes upon the wall defined by interfaced lands 25 and 25*a*, it exits via port 30—of element 20*a*. Also, port 32 in element 20 is plugged with a ball 34. The oil next enters assembly 16*a*, via port 28*a*, cycles therethrough for cooling, and exits via port 30*a*. Ports 28*b* and 30*b*, in assembly 16*b*, admit and discharge the oil thereto and therefrom, respectively. The not-being-used ports 32*a* and 32*b*, then, of assemblies 16*a* and 16*b*, respectively, are also plugged with balls 34**.

In the arrangement shown, fluid cycles through the assemblies 16, **16*a* and 16*b* serially—passing through assembly 16 in a first, circular direction, through assembly 16*a* in a second, circular direction, and through assembly 16*b* in said same first direction. Optionally, by plugging ports with the balls 34** in a different configuration, the oil can be made to course through all three assemblies in parallel, in a same direction. With yet alternative port-plugging, the oil can be cycled through a first assembly in one, circular direction, and two succeeding assemblies in parallel.

As noted, each of the halves or elements 20 and 20*a* of the body assembly 16 are identical or, as noted in the Abstract, they are mirror images of each other. The elements 20 and 20*a*, and assemblies 16, 16*a*, and 16*b*, are bolted together by means of apertured bolt lugs 38, and the assembly halves, or elements 20 and 20*a* are sealed by electron beam welding of the lands 22 and 22*a*, 24, and 24*a*, and 25 and 25*a*. In lieu of welding, the lands may be adhesive bonded. Each element 20 and 20*a* has three of the lugs 38, equally spced apart, one hundred and twenty degrees of arc. The bolt lug apertures 40 are so located as to insure the optimumly-spaced, interleaved alignment of the ribs or fins 26. With particular reference to FIG. 5 it will be noted that the internal, heat-radiating ribs or fins 26 lie in planes equally spaced apart approximately two and a half degrees of arc. Now, the lug apertures 40 have a center lying in a plane which is slightly displaced or offset, approximately three and one-eighth degrees of arc, from the plane of a nearest one of the ribs 26 at one side thereof, and displaced some more appreciable distance, approximately four and three-eighth degrees of arc, from the plane of the rib 26 nearest thereto at the side opposite. Accordingly, with the mirror-image element 20*a* on top, the corresponding port apertures 40 therein are also slightly displaced or offset from adjacent ribs or fins thereof to the same degrees, but in the opposite sense. Bolting, then, causes the fins or ribs 26 to mutually space therebetween, each thereof subsisting in a plane approximately one and one-fourth degree of arc from the plane of an adjacent, interleaved rib 26 of mating element 20 or 20*a*.

Only as an exemplary arrangement, the fins or ribs 26 have a depth of approximately four mm. (5/32 inch) and the depth of the lands 22 and 24 (and 22*a* and 24*a*) have a depth of approximately five mm. (7/32 inch), whereby a clearance obtains between the terminal end of each rib 26 and the adjacent wall surface of the mating element 20 or 20*a*. Such dimensions are arbitrary, of course, and may be predetermined by the circumstances of use of the fluid cooler body assemblies 16 (16*a*, 16*b*), as well as the flow rates, fluid pressures, and the nature of the fluid (i.e., oil, air, etc.) pertaining thereto.

Figure 7:
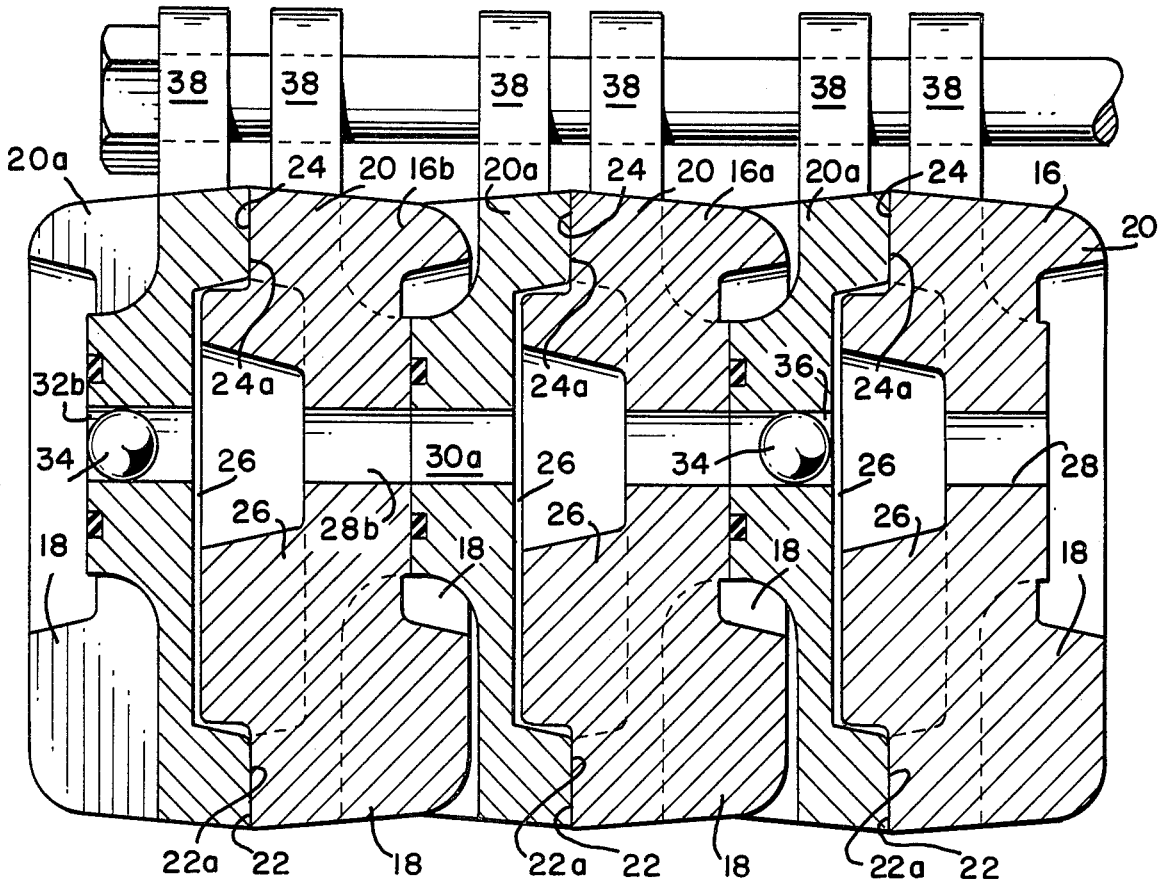
FIG. 7 is an enlarged, cross-sectional view of three, nested cooler assemblies, taken generally along section 7—7 of FIG. 1.
Figure 8:
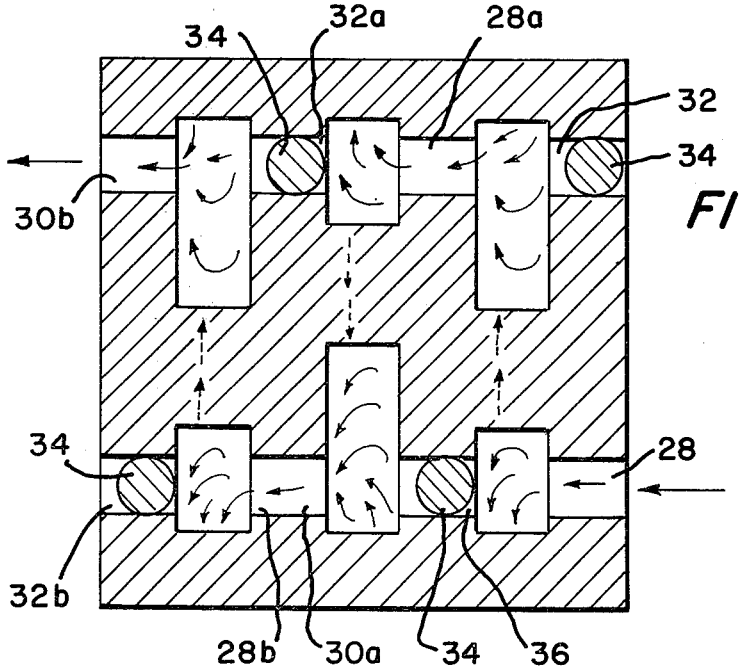
FIG. 8 is a simplified, cross-sectional view, taken generally along section 8—8 of FIG. 1, showing only diagramatically the course, through the nested cooler assemblies, which the oil may take.

As FIGS. 1, 2 and 7 evidence, the external ribs 18 interleave—similarly as ribs 26—to accommodate a closefitting packaging of the juxtaposed assemblies 16, 16*a* and 16*b*. The positioning means, or keying, provided by the lug apertures 40, also effects the interleaving of ribs 18. Ribs 18 of one element 20 or 20*a* subsist in common planes with the ribs 26 thereof. However, due to the offset displacement of the lug apertures 40, ribs 18 of a given element (20 or 20*a*) define troughs into the centers of which ribs 18 of a therewith-nesting element (20*a* or 20) position. The ribs 18 have a width or depth which is slightly less than twice the depth of abutting bosses in which communicating ports (see 30*a* and 28*b*, FIG. 7) open. Hence, ribs 18 of one element do not contact the opposed planar surface of the mating element. Rather, the latter are slightly spaced apart to define intervening voids through which, and through the aforesaid troughs as well, coolant (water, air, etc.) may freely pass.

While I have described this invention in connection with a specific embodiment thereof, it is to be clearly understood that this is done only by way of example, and not as a limitation to the scope of the invention as set forth in the objects thereof and in the appended claims.

I claim:

1. A body assembly, for a fluid cooler, comprising:

a body;

said body having a curvilinear configuration, at least and being formed of one pair of mating elements;

each of said elements having a first surface which defines an outer surface of said body, and a second surface which defines an inner surface of said body;

said second surfaces of said elements each having a first, peripheral land formed thereon, and a second land spaced-apart from, and concentric with, said peripheral land;

said peripheral lands of said elements and said concentric lands of said elements being closed upon each other to define a sealed interface therebetween; and rib means formed on said second surfaces of said elements, intermediate said lands thereof, which cooperatively define a single, undulating, fluid-accommodating channel within said body;

said undulating channel-defining rib means comprises a multiplicity of ribs extending from and normal to said second surfaces of said elements; and said ribs subsist in discrete, equally spaced apart planes; and said ribs of each of said elements are interleaved with said ribs of the other of said elements in a non-contacting, equally-spaced apart, aligned relationship; wherein each of said elements is substantially a mirror image of the other thereof;

said channel defines a fluid-accommodating pathway which (a) is concentric with said lands, and (b) constrains fluid flow therethrough to describe a multiplicity of reversing paths which extend between said second surfaces; and said channel has a greater peripheral dimension adjacent to said first land than it has adjacent to said second land, which provides said channel with a greater fluid-accommodating volume and cooling surface, adjacent to said first land than the fluid-accommodating volume and cooling surface thereof adjacent to said second land.

2. A body assembly, according to claim 1, wherein:

each of said elements has a positioning means which cooperates with the other thereof to effect said aligned relationship.

3. A body assembly, according to claim 1, wherein:

said ribs extend transverse of said second surfaces.

4. A body assembly, according to claim 1, wherein:

said lands of each said element comprise flat surfaces;

said flat surfaces subsist in a first plane; and said ribs of said elements terminate in second planes spaced apart from said first plane.

5. A body assembly, according to claim 4, wherein:

said first plane substantially bisects said ribs of said elements.

6. A body assembly, according to claim 1, further including:

radiator means, formed on said first surfaces of said elements, for radiating heat from said body assembly.

7. A body assembly, according to claim 6, wherein:
said radiator means comprises a multiplicity of ribs which extend from, and which are normal to, said first surfaces of said elements.

8. A body assembly, according to claim 7, wherein:
said ribs of said radiator means extend transverse of said first surfaces.

9. A body assembly, according to claim 1, wherein:
said elements are of a substantially annular configuration.

10. A body assembly, according to claim 1, wherein:
each of said elements has a pair of raised rims which thereupon define said lands;
said rims have a first, given depth; and
said ribs have a second, given depth which is greater than said first depth.

11. A body assembly, according to claim 10, wherein:
said second depth is slightly less then twice said first depth.

12. A body assembly, according to claim 2, further including:
a multiplicity of ribs extending transversely from, and normal to, each of said first surfaces of said elements; and wherein
said first surfaces' ribs are equally spaced apart, each thereof subsisting in a discrete plane.

13. A body assembly, according to claim 2, wherein:
said positioning means comprises apertures, formed through said elements, for receiving fastening means therewithin; and
each aperture has a center subsisting in a plane which is spaced apart a given distance from a most adjacent one of said discrete planes, and said plane of said aperture center is spaced apart from another of said discrete planes, which is next most adjacent thereto a distance greater than said given distance.

14. A body assembly, according to claim 12, wherein:
said second surfaces' ribs are equally spaced apart;
said second surfaces' ribs and said first surfaces' ribs are equal in number; and
said second surfaces' ribs subsist in said same discrete planes as said first surfaces' ribs.

15. A body assembly, according to claim 1, further including:
a multiplicity of ribs extending transverse of, and normal to, said first surfaces of said elements; wherein
said ribs of said first surfaces subsist in discrete, equally spaced-apart planes, and pairs thereof define troughs in which, centrally thereof, nestingly to receive same, first surface ribs of another, cooler body assembly; and
each of said elements has keying means which cooperates with the other thereof, and, which is cooperative with same said keying means of another cooler body assembly, to effect said nesting receipt of said first surface ribs of another cooler body assembly centrally in said troughs of said pairs of ribs.

* * * * *